US005305488A

United States Patent [19]

Lyle

[11] Patent Number: 5,305,488

[45] Date of Patent: Apr. 26, 1994

[54] TUBE CLEANING TOOL

[76] Inventor: Daniel C. Lyle, 520 Virginia Ave., Oakmont, Pa. 15139

[21] Appl. No.: 114,999

[22] Filed: Aug. 31, 1993

Related U.S. Application Data

[63] Continuation of Ser. No. 898,701, Jun. 15, 1992, abandoned.

[51] Int. Cl.[5] ..... B08B 9/04

[52] U.S. Cl. ..... 15/104.061; 15/104.16

[58] Field of Search ..... 15/3.5, 3.51, 104.05, 15/104.061, 104.16, 104.18

[56] References Cited

U.S. PATENT DOCUMENTS

| | | | |
|---|---|---|---|
| 576,425 | 2/1897 | Bilton et al. | 15/104.16 |
| 1,122,246 | 12/1914 | Beam | 15/104.05 |
| 1,612,842 | 1/1927 | Thompson et al. | 15/104.18 |
| 1,732,277 | 10/1929 | Owens | 15/104.05 |
| 2,026,680 | 1/1936 | Jacobson | 15/104.16 |
| 2,170,997 | 8/1939 | Griffin . | |
| 2,402,796 | 6/1946 | Wood | 15/104.061 |
| 2,636,202 | 4/1953 | Hinzman | 15/104.18 |
| 2,640,213 | 6/1953 | Robinson | 15/104.18 |
| 2,734,208 | 2/1956 | Griffin . | |
| 3,480,984 | 12/1969 | Kidd | 15/104.061 |
| 4,178,649 | 12/1979 | Kouse et al. | 15/104.061 |
| 4,281,432 | 8/1981 | Saxon . | |
| 4,891,115 | 1/1990 | Shishkin et al. | 15/104.16 |

FOREIGN PATENT DOCUMENTS

| | | | |
|---|---|---|---|
| 2207973 | 2/1989 | United Kingdom | 15/104.05 |

OTHER PUBLICATIONS

Brochure distributed by Conco Systems, Inc. "patented water powered tube cleaning tools", pp. 1-12, copyright 1987.

*Primary Examiner*—Harvey C. Hornsby
*Assistant Examiner*—Mark Spisich
*Attorney, Agent, or Firm*—Andrew J. Cornelius

[57] ABSTRACT

Fluid propelled tube cleaning tool for removal of deposits from the interior wall of a tube as a substantially cylindrical body, with a tail portion at one end, with a plurality of spaced cutters, with each cutter having a plurality of cutting blades extending radially from the cutters and with flexible bushings for each cutter which permit the force exerted by the cutter blades against the interior wall of the tube to be adjusted by axially compressing the flexible bushings.

28 Claims, 2 Drawing Sheets

TUBE CLEANING TOOL

This is a continuation of copending application Ser. No. 07/898,701 filed on Jun. 15, 1992 now abandoned.

FIELD OF THE INVENTION

The present invention relates to a tube cleaning tool for the loosening and/or removal of deposits from the interior wall of tubes.

BACKGROUND OF THE INVENTION

It is well known that fluid driven projectiles or scrappers can be used for the removal of mud, slim, scale or other deposits from the interior wall of a tube, such as a condenser, heat exchanger or similar tubing. Such scrappers generally comprise one or more cutters which extend outwardly from a shaft. Generally, the tail portion of the projectile will contain a section which will enable the projectile to be forced through the tubing by the use of fluid and will also allow for some fluid to pass through the projectile device, cleaning debris from in front of the projectile as the projectile moves through the tube. There are some difficulties with this arrangement, a few of which are the limited contact which a cutter blade has with the inner wall of the tube and the lack of ability to control the pressure exerted by the cutter blades on the inside wall of the tube. Examples of non-adjustable tube cleaning tools are described in U.S. Pat. No. 2,170,997, 2,734,208, and 4,281,432. The present invention is designed to overcome these difficulties by providing a new cutter design that will enable more surface area of each cutter blade to contact the inner wall of the tube. This will enable the tube to be more thoroughly cleaned on each pass of the projectile through the tube, thereby requiring fewer passes to completely clean the tube. In addition, the pressure exerted by each blade can be manually adjusted at the work site which will enable this device to be used on both hard and soft deposits on the interior wall of the tube.

SUMMARY OF THE INVENTION

The present invention relates to the mechanical scraping and cleaning of soft and hard deposits, such as sludge, manganese, etc., from the inner diameter of a tube, such as those found in condensers and heat exchangers. The present invention provides a device for the scraping and cleaning of the inside wall of the tube. This tube cleaning device, or projectile, is propelled forward by a high pressure fluid spray injected into a tube. This high pressured fluid injection is sufficient enough to advance the device through the tube, allowing the device to scrap or otherwise dislodge incrustations or other accumulations from the interior wall of the tube. Generally, said mechanical scraping tools comprise one or more fixed cutters which extend outwardly from a projectile shaft. Current devices usually have a cutter which contains two blades which contact the inside of the tube, and the present device can be distinguished from those devices, in that, the present device has a much greater percentage of contact between the cutter blades and the inner wall of the tube. This is a result of the way the cutters of the present device can be formed and then cut along its circumference. After the cutter is stamped, wherein the cutter blanks are stamped out as flat star shaped objects, the cutter is placed on a forming block. The cutter, after being formed and while still residing on the forming block, has the cutter blades cut out to a diameter equal to the inner diameter of the desired tube to be cleaned. This important process is required to differentiate it from other scrapper blade manufacturing processes and other physical designs of currently used tube cleaning devices. The process for manufacturing the present device requires that the outer end or arch of each blade be cut after the cutter is formed while it still resides on the forming block to eliminate any stress on, or deformation to, the arch of the blade. The timing of the cutting process ensures the integrity of the physical design of the cutter blade so its edge uniformly matches that of the inner diameter of the tube to be cleaned. The primary concern is for the cutter, specifically the arch shaped end of each blade, to match the inner diameter of the tube radially. The unique design of this device in conjunction with this new cutting process, will allow the contour of the arch end of each blade to more closely match the contour of the inner diameter of a tube than any other such tube cleaning device. The present device will allow a greater percentage of deposits to be scraped away and cleaned from the inner wall of the tube for each pass of the projectile through the tube.

There will also be a greater percentage of contact with the inner wall of the tube since the cutters can contain multiple blades and which can be cut from the same stock of material, thereby not only increasing the radial contact of each blade edge with the inner tube of the wall but also increasing the number of blades making contact with the wall without the introduction of more cutters on the projectile. The cost effectiveness of this cutter design is superior to the currently used devices not only because of the greater scrapping abilities of the present device, but also because of the decrease in manufacturing costs per cutter blade permitted by this particular cutter design. In addition, having more blades per cutter than current designs enables the present device to cover the entire surface area of the inner wall of the tube using fewer cutters. The ability to clean the inner wall of the tube with fewer cutters means that the present device can be physically shorter than current devices, and with the use of a flexible shaft, will permit the current device to clean even "U" bend shaped tubing.

Another unique aspect of the present device, is its ability to be compressed or sized to accommodate a particular deposit, travel resistance through the tube, and the desired pressure exertion on the inner wall of the tube. This will enable the present device to be adjusted at the work area to clean harder or softer deposits. This is accomplished by the use of flexible bushings situated along the shaft, one flexible bushing for every cutter. The purpose of this compressible bushing, which fits snugly within the cutter, is to allow the pressure exerted between the cutter blade and the inner wall of the tube to be varied, depending on the degree of compression exerted along the axis of the shaft on the flexible bushing. In other words, as the bushing is compressed down the shaft, the flexible bushing exerts an outward pressure on the cutter blades which increases the pressure of the cutter blades against the inner tube wall. The result of this increase in pressure, is to require a greater degree of force to move the projectile through the tube, thereby increasing the scrapping ability of the device. This allows the same device to be used for cleaning different kinds of deposits within the tube to be cleaned. In other words, if the deposits are soft, then less compression would be used on the flexible bushings, whereas, if the deposits within the tube to be cleaned are hard, then the compression will be increased on the flexible bushings to enable a force to be exerted on the deposits great enough to clean them from the inner wall of the tube. This has a great advantage over the current existing cleaning devices, since those devices cannot be adjusted at the site to accommodate different types of deposits on the inner wall of the tube to be cleaned.

This device is propelled through the interior of the tube by the use of fluid pressure as is commonly used today. However, the tail portion of the present invention utilizes a plurality of tear drop shaped openings on the tail section of the device which will enable fluid not only to move the projectile through the tube but also allow the fluid to flush in front of the device, thereby lessening the possibility of damaging the interior of the tube because of the lubrication caused by the fluid contacting the inner wall of the tube. These tear dropped shape openings have the ability to allow the flushing to continue even if the skirt section of the tail is compressed greater than its diameter and will enable the tail section to be used in different sized tubes without modification.

The cutters, flexible bushings and tail portion of the device are secured to each other by the use of a shaft which is twisted, thereby allowing a plurality of cutters to be automatically offset when placed onto the shaft. All of the elements of the device are then secured by the attaching of a locking member at the head, such as a tinnerman's fastener.

It is the object of the present invention to provide a tube cleaning device for loosening of both hard and soft deposits which is pressure adjustable at the work site and which has a greater contact with the interior wall of the tube which is being cleaned. It is another object of the present invention to provide a method for the removal of hard and soft deposits from the interior wall of the tube which is being cleaned, such as a condenser tube or heat exchanger tube.

DESCRIPTION OF DRAWINGS

The invention will become more readily apparent from the following description of preferred embodiance thereof shown, by way of example only, in the accompanying drawings, wherein.

DETAILED DESCRIPTION

Figures 1, 6:
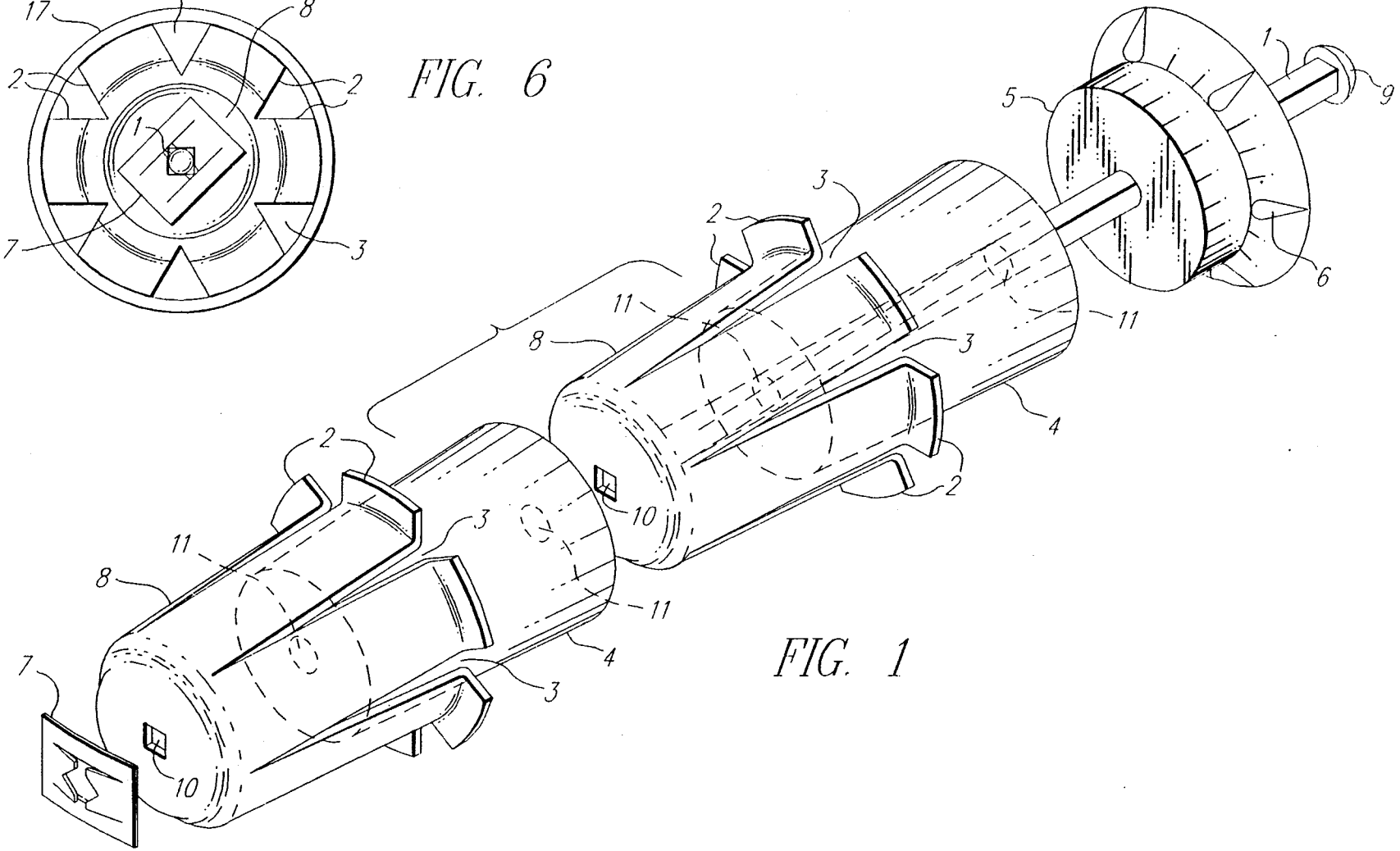
FIG. 1 is a perspective view of a scrapper assembly according to the preferred embodiment of the invention.
FIG. 6 is a top view of the tube cleaning tool of FIG. 1 located within a tube which is being cleaned.

One embodiment of the tube cleaning tool of the present invention is illustrated in FIG. 1. The tool comprises a shaft 1, a tail portion 5, a plurality of cutters 8, a plurality of bushings 4, and a locking mechanism 7.

Figure 5:
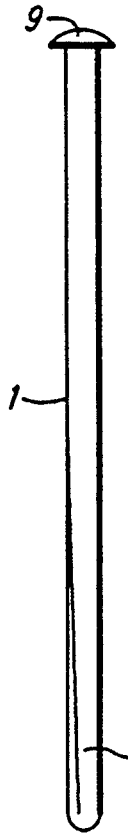
FIG. 5 is a side view of the shaft portion of the tube cleaning tool of FIG. 1 prior to assembly of the tool.

The shaft portion 1, as illustrated in FIGS. 1 and 5, is preferably formed as a rectangular shaped object with a square cross-section with a head 9 which forms a stopper. The shaft 1, contains a fixed twist 16 of 30 degrees which allows the cutters 8 and the bushings 4 to be automatically aligned in the proper rotation simply by being placed on the shaft 1.

Figure 2:
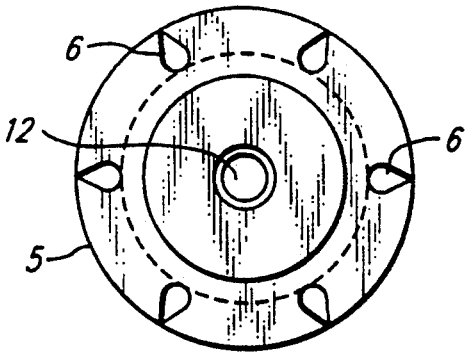
FIG. 2 is a top view of the tail portion of the tube cleaning tool of FIG. 1.
Figure 2A:
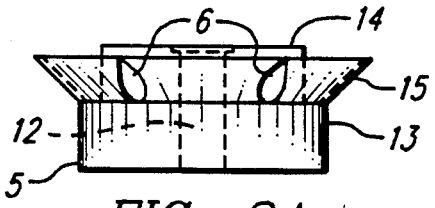
FIG. 2A is a side view of the tail portion of the tube cleaning tool of FIG. 1.

The tail portion 5, as illustrated in FIGS. 1, 2 and 2A, is preferably formed as a double annulus with the inner annulus 14 having a smaller radius than the outer annulus 13, with an extending skirt 15, containing a plurality of tear drop slits 6, with a hole 12 through its central axis of sufficient diameter to permit the shaft 1 to pass through the tail portion 5.

Figure 3:
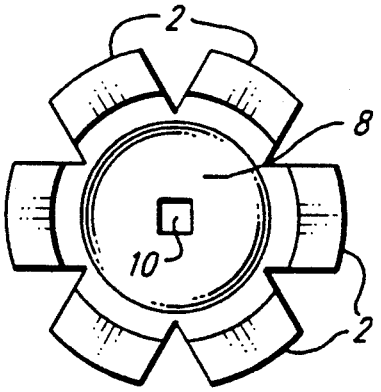
FIG. 3 is a top view of one cutter of the tube cleaning tool of FIG. 1 prior to assembly of the tool.
Figure 3A:
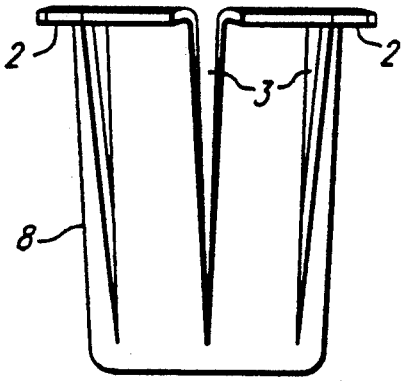
FIG. 3A is a side view of one cutter of the tube cleaning tool of FIG. 1 prior to assembly of the tool.

The cutter portion 8, as illustrated in FIGS. 1, 3 and 3A, is preferably formed as a cup in the form of a truncated cone with a plurality of slits 3 running axially along the cutter 8, and with a plurality of cutting blades 2, running outward and transverse to the slits 3 with a square hole 10 through its central axis of sufficient diameter and size to allow the cutter 8 to be placed on the shaft 1 and preventing the cutter 8 from rotating upon the shaft 1.

Figure 4:
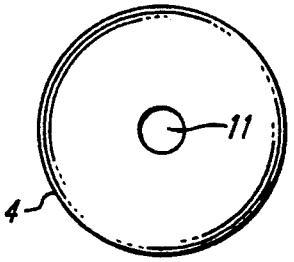
FIG. 4 is a top view of the flexible bushing portion of the tube cleaning tool of FIG. 1 prior to assembly of the tool.
Figure 4A:
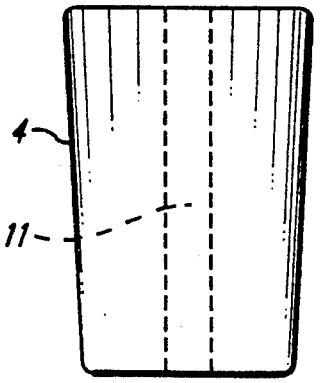
FIG. 4A is a side view of the flexible bushing portion of the tube cleaning tool of FIG. 1 prior to assembly of the tool.

The flexible bushing portion 4, as illustrated in FIGS. 1, 4, and 4A, is preferably formed as a truncated cone with a hole 11 running through its central axis, of sufficient diameter to permit the shaft 1 to pass through the flexible bushing 4.

The tail portion 5, the cutters 8, and the flexible bushings 4, are secured together on the shaft 1, as a unit. A preferred securement is by use of a locking member 7. The locking member 7, is placed upon the shaft 1, and is pushed onto the shaft with sufficient pressure to reach the desired pressure between the cutting blades 2 and the inner wall of the tube 17 to be cleaned.

What is claimed is:

1. A tube cleaning tool for the loosening or removal of deposits collected on the interior wall of a tube comprising:

a shaft having two ends and including a stop at a first said end, said shaft defining a longitudinal axis;

a substantially cylindrical shaped tail portion defining a central longitudinal axis and a hole along said central axis, said tail portion being mounted on said first end of said shaft;

at least two substantially hollow truncated cone shaped cutters each defining a central axis on the shaft with a hole through said central axis, with each cutter having a plurality of blades extending outward from the cutter transverse to said longitudinal axis of the shaft;

at least two flexible bushings, each defining a central longitudinal axis, which are substantially truncated cone shaped on the shaft with a hole through said longitudinal axis of said bushings, one for each cutter, which fits into the cutter and forces the cutter blades apart upon compression along said longitudinal axis of said shaft;

means to fasten the tail, cutters, and bushings to the shaft;

said shaft having a non-circular cross-section and the cutters having a non-circular hole through their central axes, whereby the cutters are located on the shaft but are unable to rotate around the shaft;

said shaft being twisted thirty (30) degrees along its axis to fix the angular separation of said cutters from each other on said shaft.

2. A tube cleaning tool as defined in claim 1, wherein the shaft portion has a square cross-section and each cutter portion has a square hole through its central axis.

3. A tube cleaning tool as defined in claim 2, wherein the tail portion defines an inner and an outer annulus with the inner annulus having a smaller radius than the outer annulus, with the outer annulus having a skirt which contains a plurality of tear drop slits.

4. A tube cleaning tool as defined in claim 3, wherein each cutter has six cutter blades.

5. A tube cleaning tool as defined in claim 1 wherein said shaft is comprised of material flexible enough to permit the tube cleaning tool to pass around "U" bends in the tube being cleaned.

6. A tube cleaning tool for the loosening or removal of deposits collected on the interior wall of a tube comprising:

a shaft having two ends and including a stop at a first said end, said shaft defining a longitudinal axis;

a substantially cylindrical shaped tail portion defining a central longitudinal axis and a hole along said central axis, said tail portion being mounted on said first end of said shaft;

at least two substantially hollow truncated cone shaped cutters each defining a central axis on the shaft with a hole through said central axis, with each cutter having a plurality of blades extending outward from the cutter transverse to said longitudinal axis of the shaft;

at least two flexible bushings, each defining a central longitudinal axis, which are substantially truncated cone shaped on the shaft with a hole through said longitudinal axis of said bushings, one for each cutter, which fits into the cutter and forces the cutter blades apart upon compression along said longitudinal axis of said shaft;

means to fasten the tail, cutters, and bushings to the shaft;

said shaft having a square cross-section and the cutters having a square hole through their central axes, whereby the cutters are located on the shaft but are unable to rotate around the shaft;

said tail portion defining an inner and an outer annulus with the inner annulus having a smaller radius than the outer annulus, with the outer annulus having a skirt which contains a plurality of tear drop slits.

7. A tube cleaning tool as defined in claim 6, wherein each cutter has six blades.

8. A tube cleaning tool as defined in claim 6 wherein said shaft is comprised of material flexible enough to permit the tube cleaning tool to pass around "U" bends in the tube being cleaned.

9. A tube cleaning tool for the loosening or removal of deposits collected on the interior wall of a tube comprising:

a shaft having two ends and including a stop at a first said end, said shaft defining a longitudinal axis;

a substantially cylindrical shaped tail portion defining a central longitudinal axis and a hole along said central axis, said tail portion being mounted on said first end of said shaft;

at least two substantially "U" shaped cutters each defining a central axis on the shaft with a hole through said central axis, with each cutter having two blades extending outward from the cutter transverse to said longitudinal axis of the shaft;

at least two flexible bushings, each defining a central longitudinal axis, which are substantially shaped to match the inside shape of the cutters in such a manner to prevent the cutters from rotating upon the flexible bushing on the shaft with a hole through said longitudinal axis of said bushings, one bushing for each cutter, which fits snugly into the cutter and forces the cutter blades outwardly upon compression along said longitudinal axis of said shaft;

means to fasten the tail, cutters, and bushings to the shaft;

said shaft having a non-circular cross-section and the cutters having a non-circular hole through their central axes, whereby the cutters are located on the shaft but are unable to rotate around the shaft;

said shaft being twisted thirty (30) degrees along its axis to fix the angular separation of said cutters from each other on said shaft.

10. A tube cleaning tool as defined in claim 9, wherein the shaft portion has a square cross-section and each cutter portion has a square hole through its central axis.

11. A tube cleaning tool as defined in claim 10, wherein the tail portion defines an inner and an outer annulus with the inner annulus having a smaller radius than the outer annulus, with the outer annulus having a skirt which contains a plurality of tear drop slits.

12. A tube cleaning tool as defined in claim 11, wherein each cutter has six cutter blades.

13. A tube cleaning tool for the loosening or removal of deposits collected on the interior wall of a tube comprising:

a shaft having two ends and including a stop at a first said end, said shaft defining a longitudinal axis;

a substantially cylindrical shaped tail portion defining a central longitudinal axis and a hole along said central axis, said tail portion being mounted on said first end of said shaft;

at least two substantially "U" shaped cutters each defining a central axis on the shaft with a hole through said central axis, with each cutter having two blades extending outward from the cutter transverse to said longitudinal axis of the shaft;

at least two flexible bushings, each defining a central longitudinal axis, which are substantially shaped to match the inside shape of the cutters in such a manner to prevent the cutters from rotating upon the flexible bushing on the shaft with a hole through said longitudinal axis of said bushings, one for each cutter, which fits snugly into the cutter and forces the cutter blades outwardly upon compression along said longitudinal axis of said shaft;

means to fasten the tail, cutters, and bushings to the shaft;

said shaft having a square cross-section and the cutters having a square hole through their central axes, whereby the cutters are located on the shaft but are unable to rotate around the shaft;

said tail portion defining an inner and an outer annulus with the inner annulus having a smaller radius than the outer annulus, with the outer annulus having a skirt which contains a plurality of tear drops slits.

14. A tube cleaning tool as defined in claim 13, wherein each cutter has six blades.

15. Apparatus for removing accumulated material from the interior surface of a conduit, comprising:

at least two adjustable cutters, each said cutter including at least a pair of blades, each said blade defining a scraping edge;

a tail piece defining a surface against which fluid can be directed to propel said apparatus through the conduit;

a coupling on which said adjustable cutters and said tail piece are mounted for movement relative to each other;

at least two flexible bushings, each said bushing mounted on said coupling adjacent one of at least two of said adjustable cutters, said bushings and said adjacent adjustable cutters defining cutter assemblies, the degree of compression of each said bushing determining the force said bushing exerts against said blades of said adjacent cutter to establish the scraping force applied by said blades against the interior surface of the conduit; and a bushing compression adjustor mounted on said coupling to one side of at least two said cutter assemblies that can be moved along said coupling to adjust the compression of said bushings of said at least two cutter assemblies and establish the scraping force of said cutters of said at least two cutter assemblies; movement of said adjustor establishing the degree of compression of said bushings of said at least two cutter assemblies.

16. The apparatus recited by claim 15 wherein said coupling is a rigid shaft having two ends and includes a stop at a first said end.

17. The apparatus recited by claim 16 wherein said tail piece is substantially cylindrical shaped, defines a central longitudinal axis, and defines a passage along said central axis, said tail piece being mounted on said first end of said shaft, said stop preventing said tail piece from sliding off said first end.

18. The apparatus recited by claim 17 wherein each said cutter defines a hollow truncated cone shape, and can slide along said shaft, said stop, said tail piece, said bushings and said adjustor operating to limit the extent to which said cutters can slide along said shaft.

19. The apparatus recited by claim 18 wherein said shaft has a non-circular cross-sectional shape and said cutters each define a passage corresponding in cross-sectional shape to said cross-sectional shape of said shaft, said cutters being mounted on said shaft by passing said shaft through said cutter passages, whereby rotation of said cutters on said shaft is inhibited.

20. The apparatus recited by claim 19 wherein said entire shaft is twisted a total of thirty degrees to establish a corresponding angular offset between said cutters on said shaft.

21. The apparatus recited by claim 20 wherein said shaft has a square shaped cross-section.

22. The apparatus recited by claim 21 wherein said tail piece defines an inner and an outer annulus, and further includes a skirt extending from said outer annulus, said skirt defining a plurality of tear drop slits.

23. The apparatus recited by claim 22 wherein each said cutter includes six blades.

24. The apparatus recited by claim 15 wherein said apparatus includes only two cutter assemblies.

25. The apparatus recited by claim 15 wherein said coupling is a shaft.

26. The apparatus recited by claim 25 wherein said shaft is rigid.

27. The apparatus recited by claim 15 wherein said adjustor can be moved by hand.

28. Apparatus for removing accumulated material from the interior surface of a conduit, comprising:

at least two adjustable cutters, each said cutter including at least a pair of blades, each said blade defining a scraping edge;

a tail piece defining a surface against which fluid can be directed to propel said apparatus through the conduit;

a shaft on which said adjustable cutters and said tail piece are mounted for movement relative to each other;

a flexible bushing mounted on said shaft adjacent each of at least two of said adjustable cutters, said bushings and said adjacent adjustable cutters defining cutter assemblies, the degree of compression of each said bushing determining the force said bushing exerts against said blades of said adjacent cutter to establish the scraping force applied by said blades against the interior surface of the conduit; and a bushing compression adjustor mounted on said shaft to one side of at least two said cutter assemblies that can be slid along said shaft to adjust the compression of said bushing of said at least two cutter assemblies and establish the scraping force of said cutters of said at least two cutter assemblies;

said cutting blades of each said cutter defining a space in which at least a part of each said bushing is disposed, the degree of compression of each said bushing determining the extent to which said bushing forces said cutting blades of said adjacent cutter outward to establish the scraping force of said blades;

movement of said adjustor establishing the degree of compression of said bushings of said pair of cutter assemblies.

* * * * *